US008826551B2

(12) United States Patent
Gibson

(10) Patent No.: US 8,826,551 B2
(45) Date of Patent: Sep. 9, 2014

(54) SPECIAL BOW SIGHTING IMPROVEMENT KNOWN AS THE REVOLVER

(76) Inventor: Craig Gibson, Springport, IN (US)

( * ) Notice: Subject to any disclaimer, the term of this patent is extended or adjusted under 35 U.S.C. 154(b) by 273 days.

(21) Appl. No.: 13/474,482

(22) Filed: May 17, 2012

(65) Prior Publication Data

US 2012/0291296 A1 Nov. 22, 2012

Related U.S. Application Data

(60) Provisional application No. 61/487,613, filed on May 18, 2011.

(51) Int. Cl.
*F41G 1/467* (2006.01)
*F41G 1/473* (2006.01)
*F41G 1/34* (2006.01)

(52) U.S. Cl.
CPC ..... *F41G 1/467* (2013.01); *F41G 1/473* (2013.01); *F41G 1/345* (2013.01)
USPC ..... 33/265; 124/87

(58) Field of Classification Search
CPC ..... F41G 1/345; F41G 1/473; F41G 1/30; F41G 1/14; F41G 1/467; F41B 5/14
USPC ..... 33/265; 124/87
See application file for complete search history.

(56) References Cited

U.S. PATENT DOCUMENTS

| | | | | |
|---|---|---|---|---|
| 5,367,780 | A | 11/1994 | Savage | |
| 6,073,352 | A | 6/2000 | Zykan et al. | |
| 6,311,405 | B1 | 11/2001 | Slates | |
| 6,494,604 | B2 | 12/2002 | Khoshnood | |
| 6,952,881 | B2 * | 10/2005 | McGivern | 33/265 |
| 7,290,345 | B2 | 11/2007 | Ellig | |
| 7,328,515 | B2 | 2/2008 | Helm et al. | |
| 7,343,686 | B2 | 3/2008 | Rager | |
| 7,487,594 | B2 | 2/2009 | Labowski | |
| 7,503,321 | B2 | 3/2009 | Afshari | |
| 7,574,811 | B2 | 8/2009 | Kurtzhals et al. | |
| 7,814,668 | B1 | 10/2010 | Pulkrabek et al. | |
| 8,065,807 | B2 * | 11/2011 | Rucinski | 33/265 |
| 8,272,137 | B2 * | 9/2012 | Logsdon | 33/265 |
| 8,316,551 | B2 * | 11/2012 | Gorsuch et al. | 33/265 |
| 2003/0101604 | A1 * | 6/2003 | McGivern | 33/265 |
| 2006/0254065 | A1 | 11/2006 | Grace | |
| 2010/0115778 | A1 * | 5/2010 | Gorsuch et al. | 33/265 |
| 2012/0046100 | A1 * | 2/2012 | Roman et al. | 463/30 |
| 2012/0291296 | A1 * | 11/2012 | Gibson | 33/265 |

* cited by examiner

*Primary Examiner* — Yaritza Guadalupe-McCall
(74) *Attorney, Agent, or Firm* — Ritchison Law Offices; John D. Ritchison

(57) ABSTRACT

A bow sighting improvement device employing fiber optic elements and using an electro-mechanical control to illuminate one pin only and to provide a leveling control function to the optic system. The device is secured to the archery bow and fiber optic bow sight. It is comprised of a revolver device with a power source, light source and a control system with features; a means to attach the revolver to an optical bow sight that sight having at least two fiber optic sight tips powered each by a fiber strand; a means to attach the revolver device to an archery bow wherein the control system may singularly power one fiber optic strand and light one sight tip and wherein the intensity of the lighting of the tip may be controlled; a tilt/torque switch assembly; and a means for connecting the tilt switch assembly to the revolver control system.

14 Claims, 17 Drawing Sheets

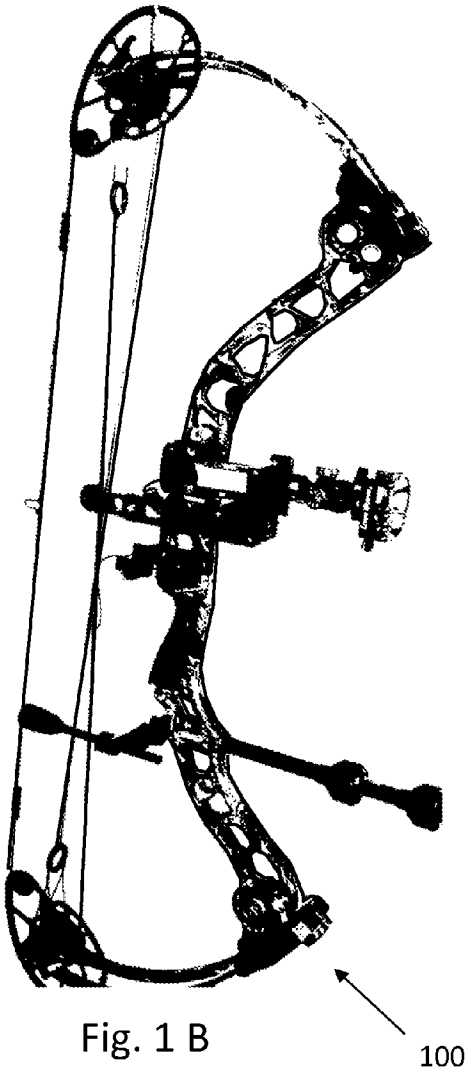
Fig. 1 B
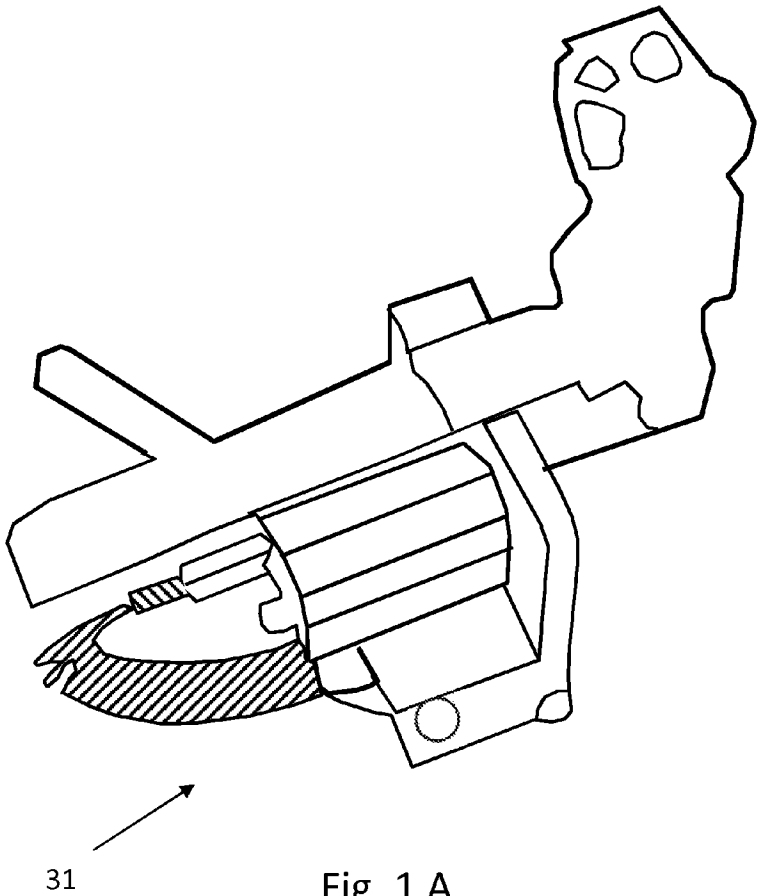
Fig. 1 A
Fig. 1

100

31

32

Torque System
Plug
Laser diode
(Light Source)
Switch
Batteries
90

41

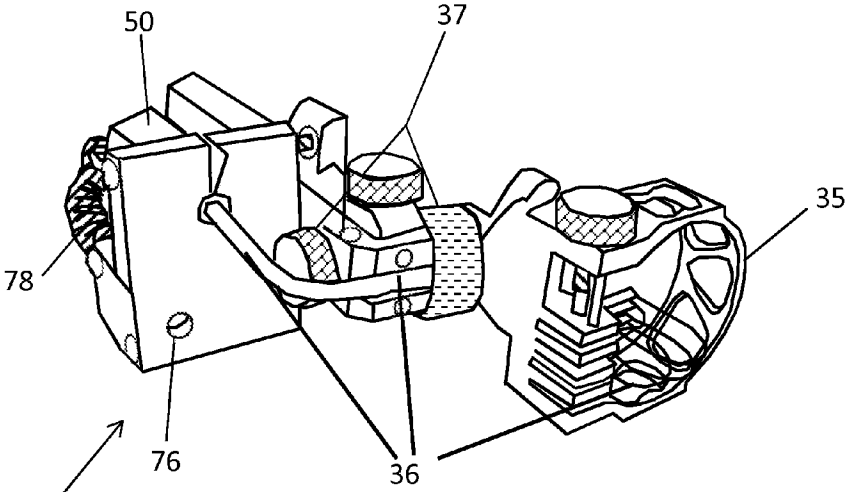
Fig. 5 A
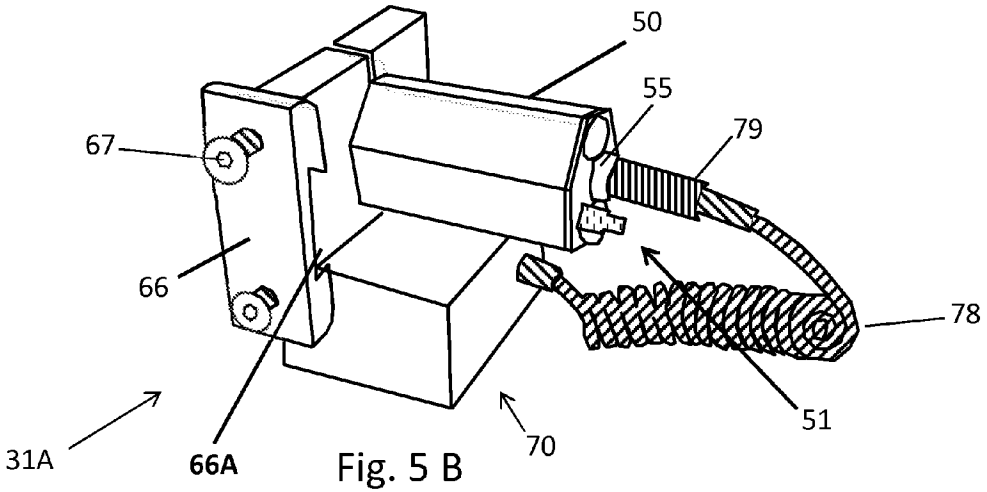
Fig. 5 B
Fig. 5

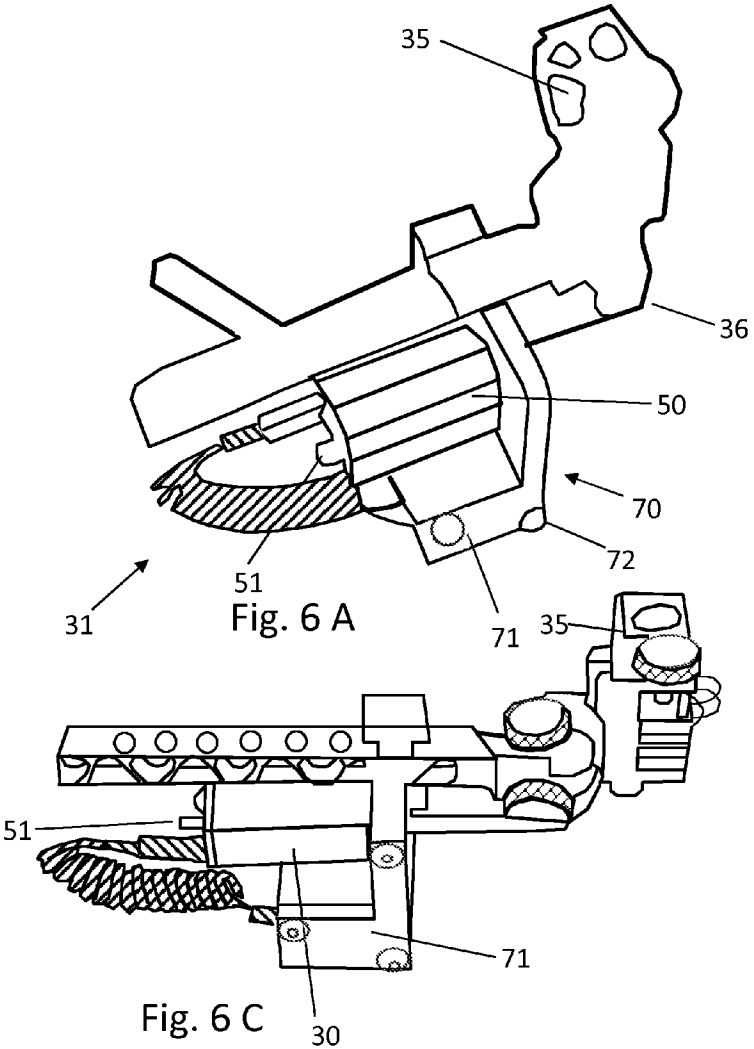
Fig. 6 A
Fig. 6 C
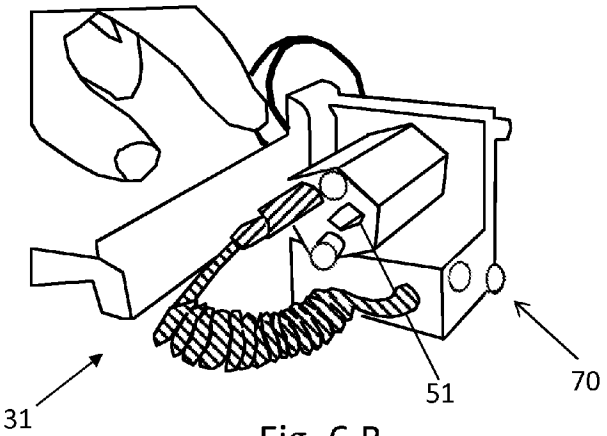
Fig. 6 B
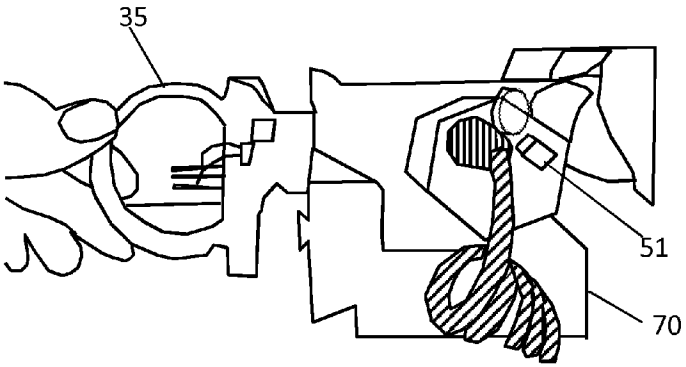
Fig. 6 D
Fig. 6

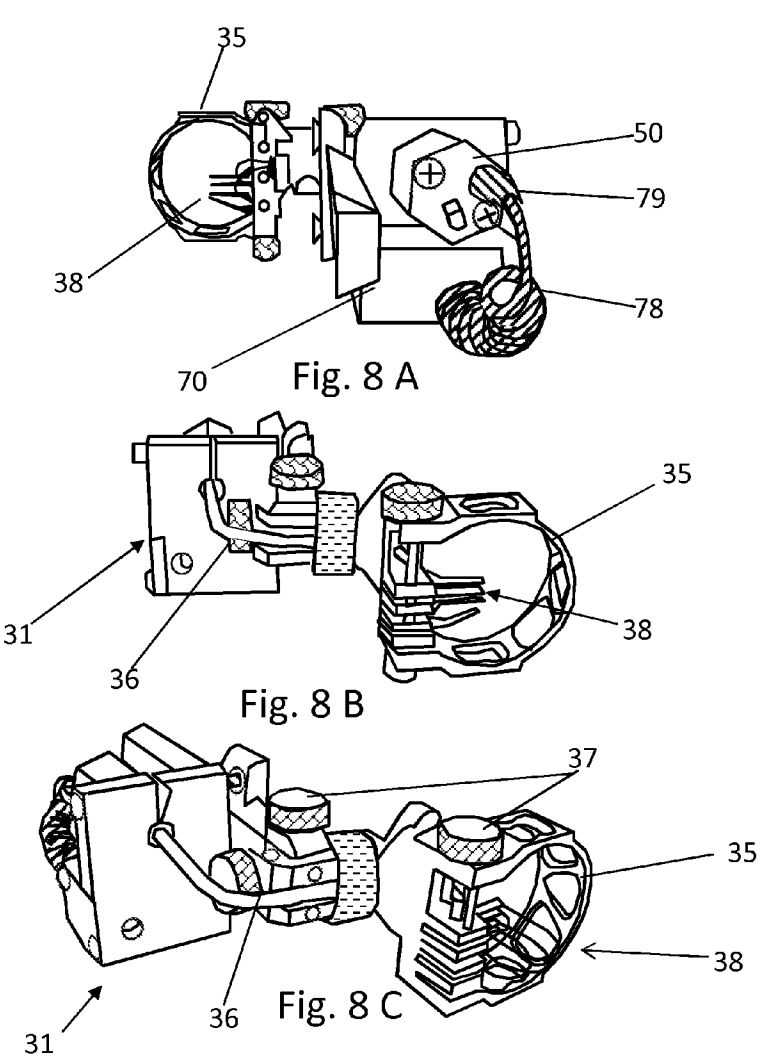
50
79
78
35
38
70
Fig. 8 A
35
38
36
31
Fig. 8 B
35
38
37
36
31
Fig. 8 C
Fig. 8
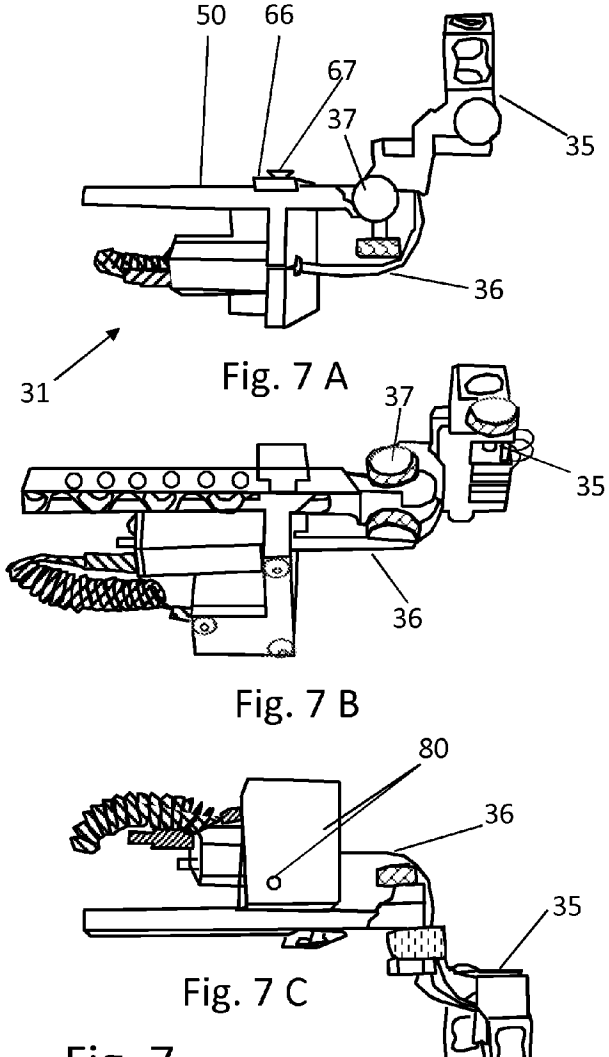
35
36
67
37
66
50
31
Fig. 7 A
35
37
36
Fig. 7 B
35
36
80
Fig. 7 C
Fig. 7

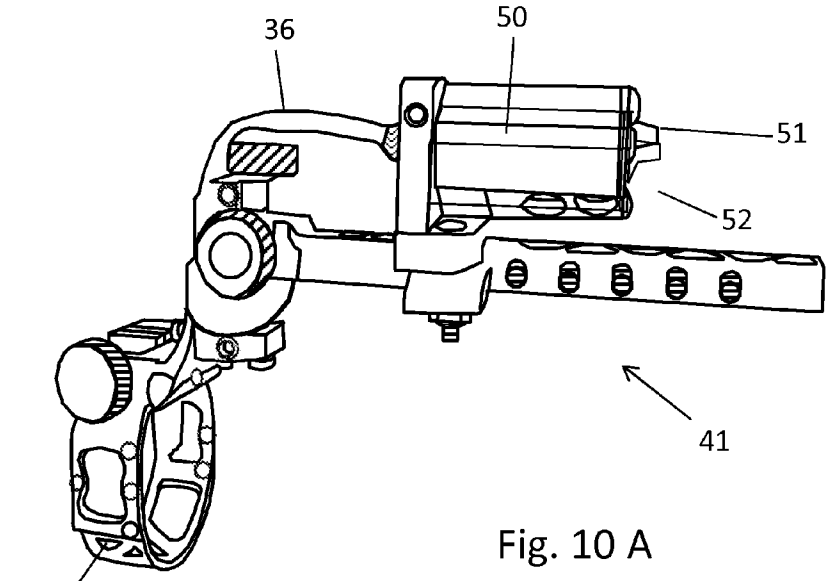
Fig. 10 A
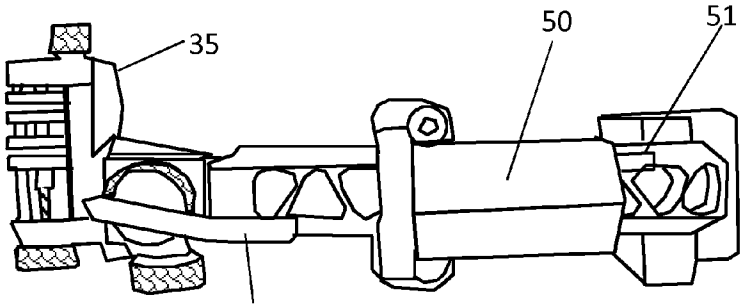
Fig. 10 C
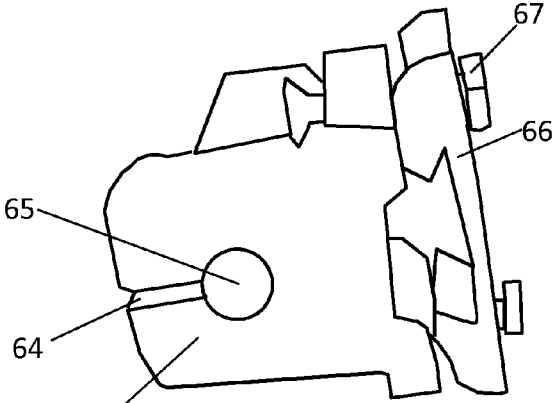
Fig. 10 B
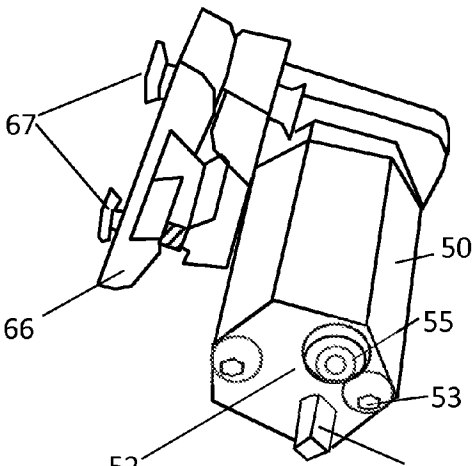
Fig. 10 D
Fig. 10

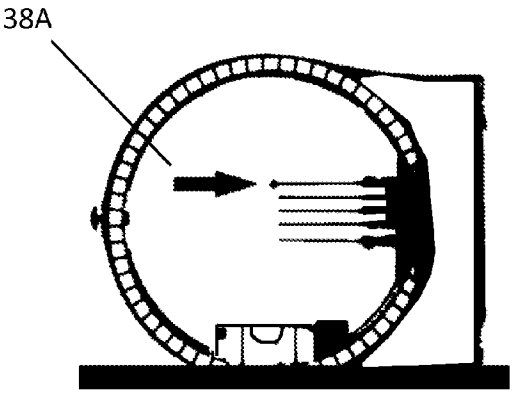
Fig. 12 A
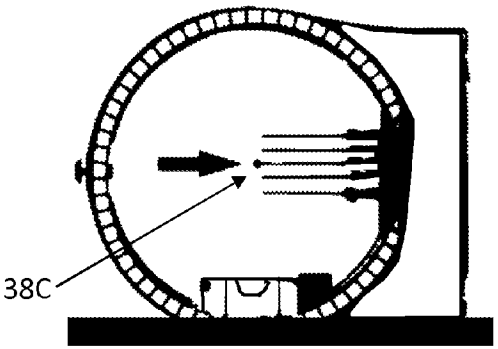
Fig. 12 B
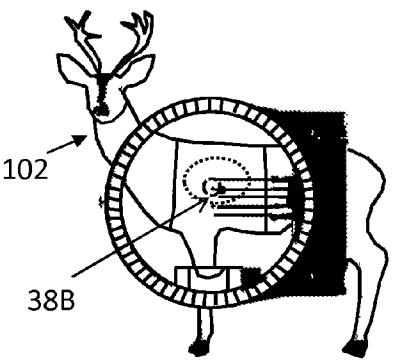
Fig. 12 C
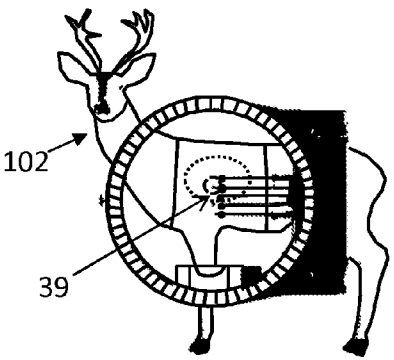
Fig. 12 D
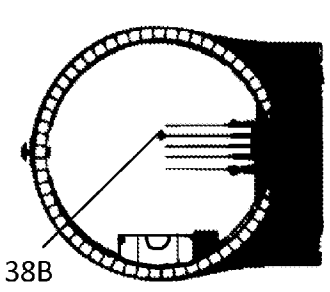
Fig. 12 E
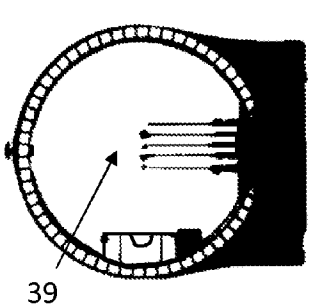
Fig. 12 F
Fig. 12

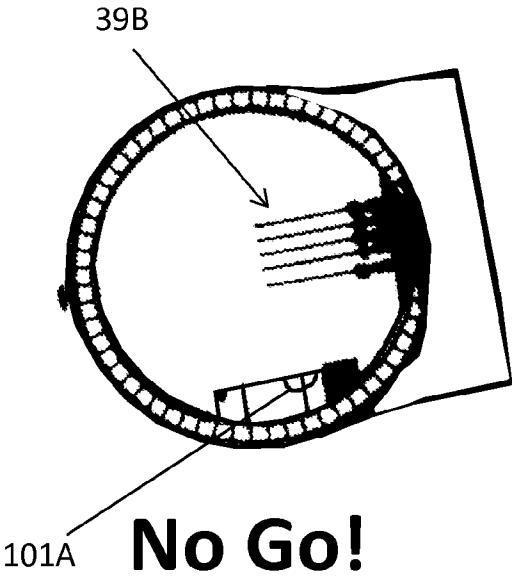
Fig. 13 C
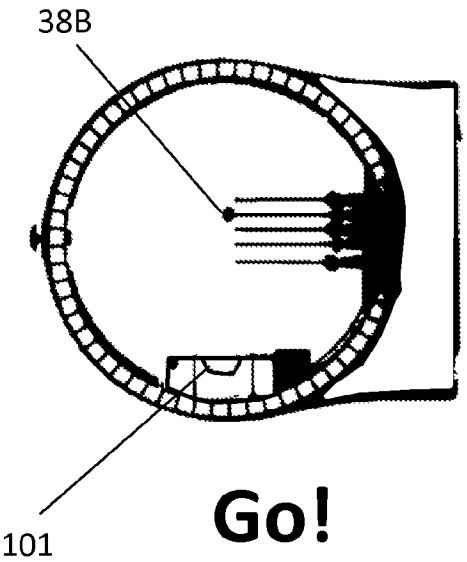
Fig. 13 B
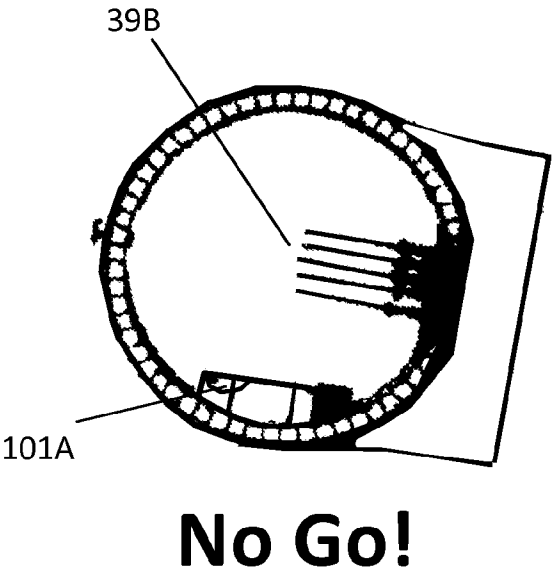
Fig. 13 A
Fig. 13

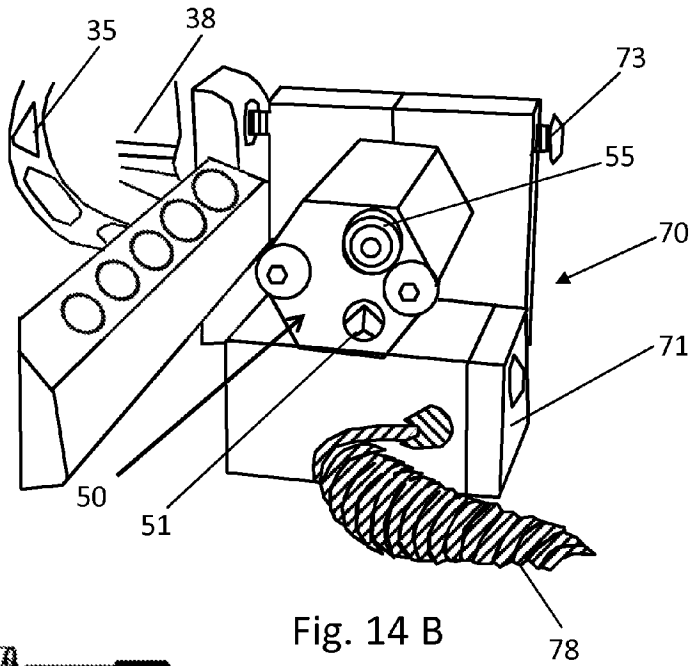
Fig. 14 B
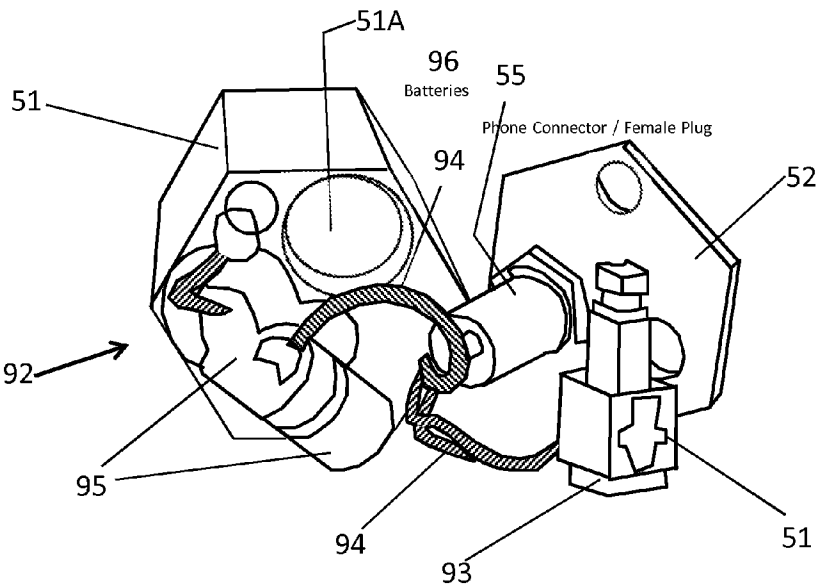
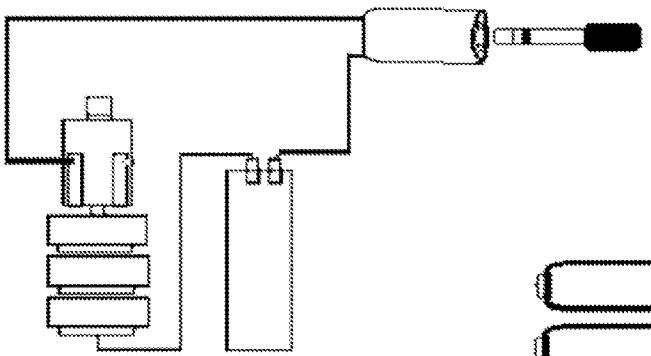
Fig. 14 A
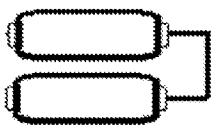
Fig. 14 C
90
Fig. 14

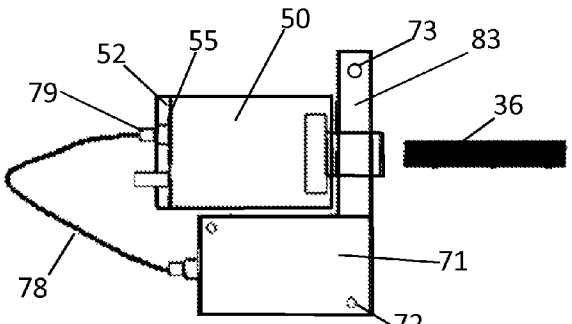
Fig. 16 B
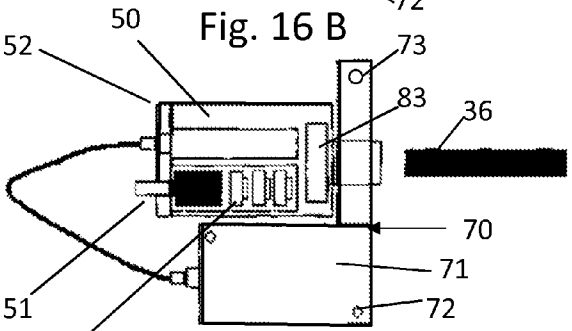
Fig. 16 C
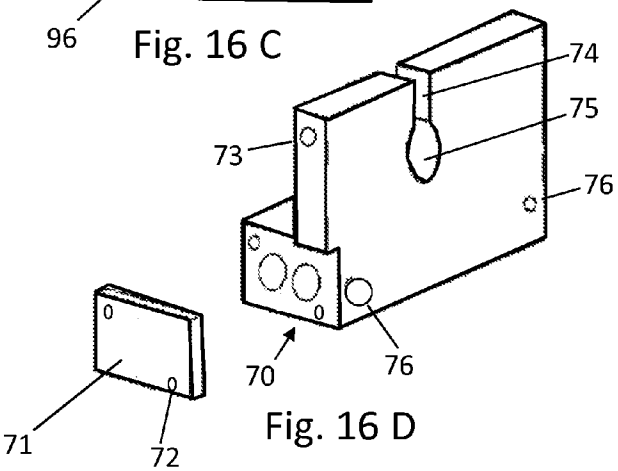
Fig. 16 D
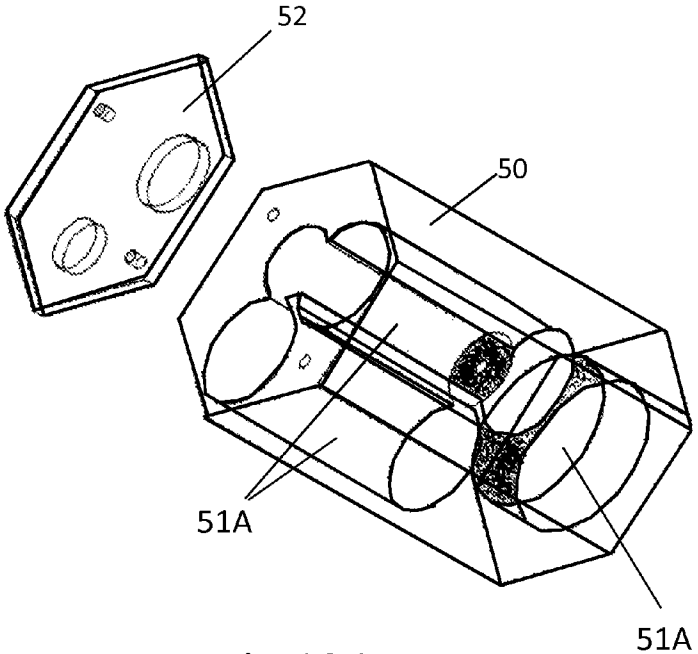
Fig. 16 A
Fig. 16

70
A
A
83
70
70A
83
70
72
70A 75
70
76
74
76

70

83
85

Section A-A
72
71

ALL PRIOR ART

SPECIAL BOW SIGHTING IMPROVEMENT KNOWN AS THE REVOLVER

CROSS-REFERENCE TO RELATED APPLICATIONS

This application claims the benefit of Provisional Patent Application Ser. No. 61/487,613 filed May 18, 2011 by Craig Gibson and entitled "Special Bow Sighting Improvement known as the Revolver".

FIELD OF INVENTION

This invention relates to a Special Bow Sighting Improvement known as the Revolver. Particularly this product is related to sights for archery bows or firearms employing fiber optic elements and, more specifically, to sight pin constructions which provide increased focus and stability to the fiber optic element by illuminating one pin only and by providing a leveling function to the optic system.

The Special Bow Sighting Improvement known as the Revolver works from an electro-mechanical design that employs a control over the illumination of the sight pins and an optional leveling function which controls the illumination if the bow is not plumb. The improvement device is secured to the archery bow and fiber optic bow sight. The power source and control system is self-contained in the device and may be easily installed to virtually all bows with universal mounting connections. The device anticipates placement with original equipment or as an aftermarket add-on to existing bow and bow sights.

FEDERALLY SPONSORED RESEARCH

None.

SEQUENCE LISTING OR PROGRAM

None.

BACKGROUND

Field of Invention and Prior Art

Problem Addressed

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. Sights are normally utilizing a plurality of sight pins having their tips vertically aligned, each individual sight pin is typically provided for aiming the bow at a target at a particular distance from the archer. For example, one pin may be positioned in the sight for aiming the bow at a target 15 yards from the archer while another pin may be positioned for a target that is at 50 yards distance. Unfortunately, all pins are lit at the same time. This causes a blur condition for the archer. The Special Bow Sighting Improvement known as the Revolver allows only one sight tip to be illuminated.

Many of the known sighting devices are impractical for hunting where not only the target distance must be rapidly brought into focus in sufficient time to adjust the positioning of the sight but the archer must be able to immediately recognize that the vertical alignment of the bow has not twisted to one side or the other of the target. Therefore the bow may have a cant or tilt from a plumb condition. This also impacts the trajectory of the arrow. Therefore, the Special Bow Sighting Improvement known as the Revolver provides the optional ability to turn-off the light source to the optics if the bow is not plumb. As far as known, there are no Special Bow Sighting Improvement known as the Revolver or the like. It is believed that this product is unique in its design and technologies.

PRIOR ART

A U.S. Pat. No. 7,574,811 was issued to Kurtzhals, et al. in 2009 called an "Adjustable bow sight apparatus." It taught a bow sight including an adjustment system that may include an elevation adjustment mechanism and a windage adjustment mechanism. The user can adjust the elevation and/or windage of a sight component of the bow sight with the adjustment system. There was no automatic leveling indication or single pin illumination demonstrated as is shown in this Gibson device. A U.S. Pat. No. 7,487,594 was issued to Labowski in 2009 called a "Sighting device". It demonstrated a sighting device and method of sighting for a bow or shooting instrument. A photo optic cable or other light transmitting flexible tubular member receives light from a light emitting diode and transmits it to the other end of the tube. The initiator is responsive to an electronic level that the bow is within a predetermined angle of side-wise tilt. The second end of the tubular member is positioned to provide a sight point for the bow. The Labowski device is very complex and has more parts than the Gibson device. Also, there was no automatic leveling indication to actually shut down the light or single pin illumination demonstrated as is shown in this Gibson device.

A U.S. Pat. No. 6,494,604 issued to Khoshnood in 2002 is called a "Bow sight system". Here is shown an electronically lighted sighting device for use in conjunction with an archery bow. The sight includes an electronic circuitry with at least one switch, a plurality of LEDs and elongated fiber optic pins, and having one end of each fiber optic pin located in front of an LED and the other end extended and formed to act as an aiming point. A fiber optic pin transmits the light from the associated LED to the other end of the fiber optic pin or filament, the filament tip then acts as the bright aiming point. The electronic circuitry is powered by batteries and is programmed such that by actuating the switch the archer can select each of the LEDs, individually or collectively, for illumination, along with illumination intensity levels. There was no automatic leveling indication combined with a single pin illumination demonstrated as is shown in this Gibson device. In addition, the device has more complex PC boards involved with additional parts and complexity which should drive the relative cost of the device higher than the Gibson device. Another U.S. Pat. No. 7,328,515 was issued to Helm, et al. in 2008 for a device called "Archery bow sights and archery bows including same". Here is revealed an archery bow sights, and archery bows including same are described, the bow sight comprising a sight pin guard having a portion defining a sighting plane, a rotatable shaft having ends installed in the sight pin guard, and at least one sight pin having a connector end and a sight end, the connector end removably and adjustably installed on the rotatable shaft.

Certain embodiments comprise a plurality of sight pins arranged on the rotatable shaft at different longitudinal and circumferential locations so that upon rotation of the shaft a different one of the sight pins is viewable in the plane defined by the sight pin guard. There was no automatic leveling indication or single pin illumination demonstrated with this device as is shown in the Gibson device. Gibson controls the power to parallel lights. This Helm patent controls the position and powering to the lights through rotation. It does not anticipate Gibson.

Still another U.S. Pat. No. 7,503,321 was issued to Afshari in 2009 called the "Illuminated sight pin". Demonstrated by this inventor is a sighting device for use with a firearm or bow comprised of a fiber optic member having a sight end visible by a user for aiming the firearm or bow at a target. A non-electrical, light-emitting material is disposed over a length of the fiber optic element in order to illuminate the fiber optic element in low light or no ambient light conditions. The non-electrical, light-emitting material may be incorporated into the sighting device in order to provide sufficient surface contact with the fiber optic member to provide adequate illumination as well as illumination of the sighting device itself. There was no automatic leveling indication or single pin illumination demonstrated as is shown in this Gibson device. One other U.S. Pat. No. 6,311,405 that was issued to Slates in 2001 is entitled "Fiber optic pin sight for a bow". This device was a fiber optic pin sight that includes a fiber optic pin holder which grips the pin to secure the pin in the sight. The pin holder includes a threaded shaft having a bore through which the pin extends and a nut which is threaded about the shaft. The shaft is sloped outwardly at its back end and includes a slot which extends forwardly from the back end to define a pair of spaced apart flexible legs. When the nut is threaded over the expanded back end of the shaft, the legs are urged together to grip the pin. Again, here was not shown an automatic leveling indication nor a single pin illumination demonstrated as is shown in this Gibson device.

A U.S. Pat. No. 6,073,352 issued to Zykan, et al. in 2000 is called a "Laser bow sight apparatus". This shows a laser rangefinder bow sight adapted for use preferably with a conventional multi-pin bow sight having a frame and a plurality of sighting pins adjustably positioned on said frame. The laser rangefinder has a housing removably fastened to the bow sight frame. There was no automatic leveling indication or single pin illumination demonstrated as is shown in this Gibson device. Another U.S. Pat. No. 7,343,686 issued to Rager in 2008 is called a "Bow sight with fiber optics". This device demonstrates a bow sight having a support structure, and two or more vertically aligned vertical pins connected to the support structure that is provided. At least two of the vertical pins include a sight point. In accordance with another aspect of the invention, a bow sight having a support structure connected to two or more sight points is provided. The two or more sight points are rotationally adjustable such that they can be rotated into vertical alignment. The Gibson improvements for level indication and single pin illumination are not shown.

In 1994, a U.S. Pat. No. 5,367,780 was issued to Savage called an "Archery bow torque sight". It demonstrated an archery bow torque sight that allows an archer to improve accuracy by overcoming or substantially reducing the twisting and/or turning motion of a bow about the hand grip when force is applied as the archer draws the bow to an anchor point. The torque bow sight includes an elongated support bracket having a front sight in which a first single sight line is vertically disposed and a rear sight in which a second single sight line is vertically disposed so as to be superimposed over the first monofilament. It does not show or anticipate Gibson features. The U.S. Pat. No. 7,814,668 issued to Pulkrabek, et al. in 2010 is called an "Eye alignment assembly". This device teaches an eye alignment assembly for aligning a tool with a user. The eye alignment assembly is mounted to the tool. The eye alignment assembly includes a sight point of an optical fiber positioned a distance behind an alignment indicia on a lens. There was no automatic leveling indication or single pin illumination demonstrated as is shown in this Gibson device.

A U.S. Pat. No. 7,290,345 issued to Ellig in 2007 is named a "Bow sight with controlled light intensity sight pin". This demonstrates an improved sighting device. The sight may be used on a bow or other device which is typically sighted on an object during use. The sight includes at least one light-gathering fiber-optic fiber having at least one end from which absorbed light may be transmitted for viewing by a user. The fiber-optic fiber includes an associated element that regulates the amount of light absorbed in inverse proportion to the impinging light intensity in an automatic manner providing a more constant light intensity output. Again, there was no automatic leveling indication or single pin illumination demonstrated as is shown in this Gibson device. A Patent Application Publication No. 20060254065 for Grace was published in 2006 called an "Archery Bow Sight". Taught here is a bow sight including a mechanism that moves a sight element, while maintaining the alignment of associated sight indicia with a substantially linear axis, by way of a simple adjustment of the mechanism. The adjustment mechanism can include a substantially curvilinear portion and an optional substantially linear portion, and associated projections guided by the curvilinear and linear portions, that move the sight indicia along a substantially linear, vertical axis. Where there are multiple sight elements, multiple, unique adjustment mechanisms maintain each associated sight indicia in alignment with the axis while providing adjustment of the spacing between sight indicia. None of the Gibson features are revealed.

As far as known, there are no Special Bow Sighting Improvement known as the Revolver or the like. It is believed that this product is unique in its design and technologies.

SUMMARY OF THE INVENTION

This invention is Special Bow Sighting Improvement known as the Revolver. Taught here are the ways a bow sight may be improved to light only one pin at a time and how to have a way to indicate when the bow is not plumb by shutting down the light source. One of the Special Bow Sighting Improvement known as the Revolver devices is placed and removably secured on the archery bow with the optical bow sight and then easily adjusted and controlled by the archer.

The preferred embodiment of the Special Bow Sighting Improvement known as the Revolver is comprised of (a) a revolver device with a power source, light source and a control system with features; (b) a means to attach the revolver to an optical bow sight that sight having at least two fiber optic sight tips powered each by a fiber strand; and, (c) a means to attach the revolver device to an archery bow wherein the control system may singularly power one fiber optic strand and light one sight tip and wherein the intensity of the lighting of the tip may be controlled. An optional additional embodiment includes the above and is comprised additionally of (d) a tilt/torque switch assembly and (e) a means for connecting the tilt switch assembly to the revolver control system wherein the level and plumb-ness of the bow may control the lighting source to the bow tips.

The newly invented Special Bow Sighting Improvement known as the Revolver may be manufactured at low volumes by very simple means and in high volume production by more complex and controlled systems.

Objects and Advantages

There are several objects and advantages of the Special Bow Sighting Improvement device known as the Revolver. There are currently no known bow sight control systems or devices that are effective at providing the objects of this invention.

In the archery field bow sights generally have multiple sight points for use in shooting arrows into targets of different distances from the archer. Many bow sights include multiple sight points attached to horizontal pins. If the sights are illuminated by a light source from fiber optics, all the pins are currently lit at the same time. Frequently, the tips are different colors and create an array of lighted "dots". However, the lights blur together and create a confusion and decision for the archer to make. Given the power and speed of modern bows, the smallest distraction (ie a blurry sight) may result in a poor sight to target correlation. By eliminating the blur, the decision of which pin is not required and the distraction is also eliminated. Through the same control system, the light intensity may be increased or decreased as the revolver "turns". Therefore, the intensity may be controlled and increased/decreased for the surrounding environment. A low light condition (dawn, dusk or night) may use a lower intensity versus a bright intensity needed at high light conditions during the day. This Special Bow Sighting Improvement device known as the Revolver also has the option to control the light being on or off depending on the tilt/cant/torque of the bow. If the bow is tilted, the light is not powered. This alternative option may be disengaged so that bow shots needing a canted bow (off plumb) can still use the revolver and single tip illumination.

The Special Bow Sighting Improvement device known as the Revolver may significantly assist an archer's ability to concentrate and make a better sighting and shot at a contest target or hunting prey by eliminating or reducing several distractions during the bow sighting process. When sighting the bow, the use of the Special Bow Sighting Improvement device known as the Revolver:

- permits the archer to concentrate on one pin;
- prevents a blurred condition of sight pins; and
- may have the no-tilt option to remove the added distraction of a non-plumb/canted bow.

The installation, production and marketing of the device:

- easily adapts to the current bow mounts;
- easily adapts to current optical bow sights;
- may be packaged for retail or internet sales;
- may be manufactured in low or high volume builds;
- uses readily available materials and components; and
- uses existing production processes and equipment.

Finally, other advantages and additional features of the present Special Bow Sighting Improvement device known as the Revolver will be more apparent from the accompanying drawings and from the full description of the device. For a person having ordinary skill in the field of bow and bow sighting devices, laser lighting techniques, and fiber optics and all their related uses, it is readily understood that the features shown in the examples with this product are readily adapted to other types of bow sighting and other hunting systems and devices using fiber optics.

DESCRIPTION OF THE DRAWINGS

Figures

The accompanying drawings, which are incorporated in and constitute a part of this specification, illustrate an embodiment of the Special Bow Sighting Improvement device known as the Revolver that is preferred. The drawings together with the summary description given above and a detailed description given below serve to explain the principles of the Special Bow Sighting Improvement known as the Revolver. It is understood, however, that the device and system shown is not limited to only the precise arrangements and instrumentalities shown.

FIGS. 1 A and 1 B are sketches of the Special Bow Sighting Improvement known as the Revolver with the tilt/torque feature and the device mounted onto a bow.

FIGS. 5 A and 5 B are sketches of a prototype sample of the Special Bow Sighting Improvement known as the Revolver with the components and features from generally the bow sight end and revolver enclosure end views.

FIGS. 6 A through 6 D are sketches of the Special Bow Sighting Improvement from several views.

FIGS. 7 A through 7 C are sketches of the prototype of the tilt/torque device from side, top and bottom views.

FIGS. 8 A through 8 C are sketches of the prototype of the tilt/torque device from the Revolver end and from the bow sight end.

FIGS. 10 A through 10 D are sketches of a prototype sample of the Special Bow Sighting Improvement known as the Revolver without the tilt/torque function with the components and features.

FIGS. 12 A through 12 F are sketches showing the single pin versus the multi-pin lighting of the sight pins for the device mounted onto the bow.

FIGS. 13 A through 13 C are sketches of the Special Bow Sighting Improvement device functioning in the tilt/torque mode.

FIGS. 14 A through 14 C are sketches of a prototype sample electrical circuits, enclosure and the electrical layout of the system.

FIGS. 16 A through 16 D are sketches and drawings of a prototype layout of the Special Bow Sighting Improvement device.

REFERENCE NUMERALS

Figures 2, 2A, 2B, 2C, 2D, 2E:
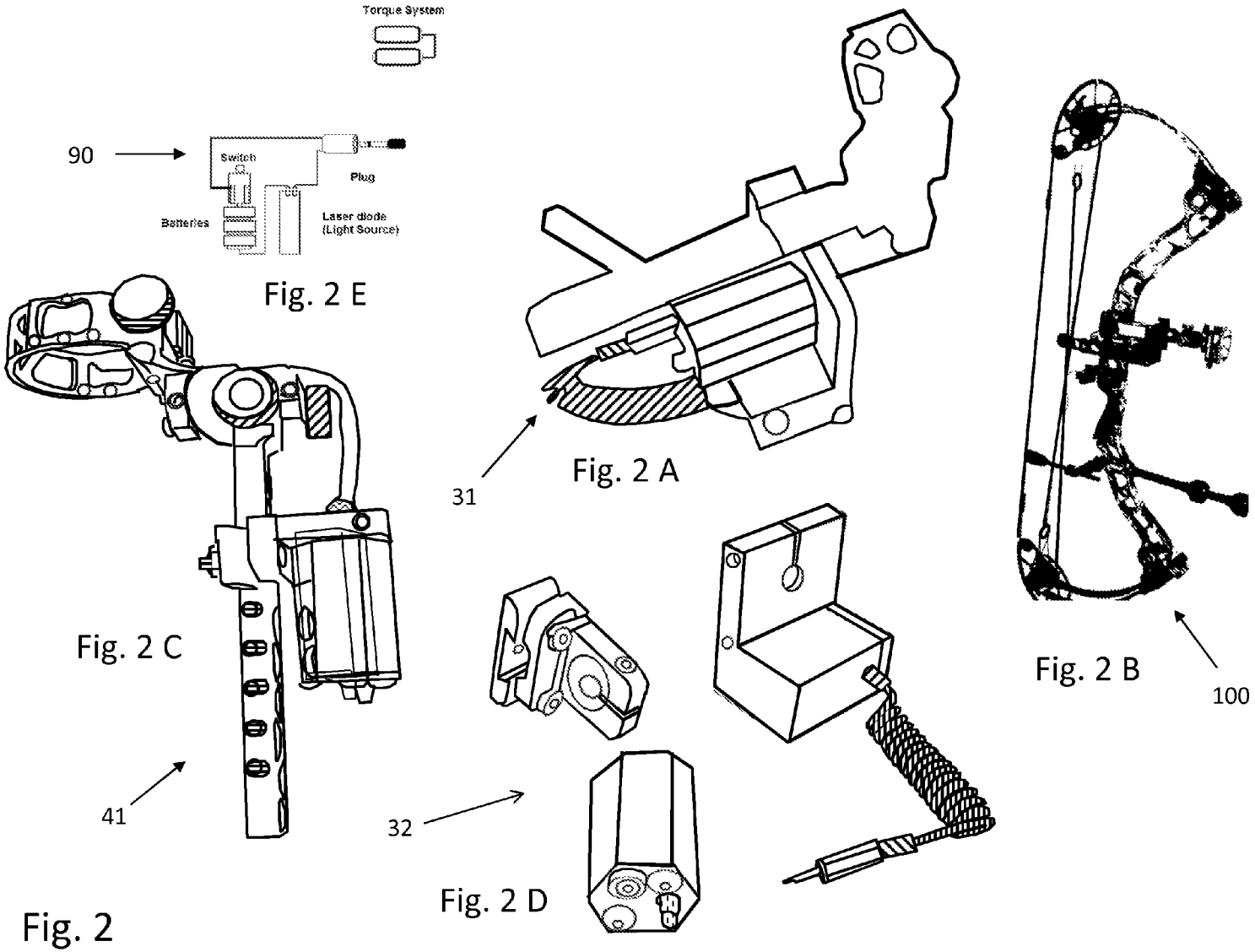
FIGS. 2 A through 2 E are sketches of the Special Bow Sighting Improvement known as the Revolver and other general views and alternative embodiments for the device.

The following list refers to the drawings:

TABLE B

Reference numbers

| Ref # | Description |
|---|---|
| 31 | Bow hunter's device with a torque/tilt function |
| 31A | Prototype of Bow hunter's device with a torque/tilt function |
| 32 | General components of the device |
| 35 | Bow sight with fiber optic lighted sight pins |
| 36 | Optical fibers |
| 37 | Fiber optic adjustments |
| 38 | Fiber optic sight pins |
| 38A | Top pin |
| 38B | Second pin lit up due to level condition of bow |
| 38C | Middle pin |
| 39 | All pins lit and blurred |
| 39B | Pins unlit due to tilt mode prevention |
| 41 | Revolver only - single pin lighting; no tilt function |
| 50 | Revolver enclosure |
| 51 | Switch - select tilt on/manual on (single pole, double throw or equal) |
| 51A | Apertures or voids internal to the enclosure 51 for containing the batteries, light source switch and conductors |
| 52 | Revolver face cover plate |
| 53 | Face cover means for mounting(fasteners, bolts, or the like) |
| 55 | Tilt/torque electrical plug receiver |
| 60 | Revolver (only) mount |
| 63 | Means for tightening(fasteners such as bolts or the like) |
| 64 | Tightening clearance slot |
| 65 | Mounting aperture for light source mounting means |
| 66 | Bow mount clamp component |
| 66A | Clamp slot |
| 67 | Means to lock revolver device to bow or to mount |
| 70 | Revolver and tilt combination mount |
| 70A | Aperture/void in tilt mount 70 for tilt switch 97 |
| 71 | Tilt mount end plate |
| 72 | Means for mounting plate 71 (fasteners or the like) |
| 73 | Means for tightening(fasteners such as bolts or the like) |
| 74 | Tightening clearance slot for tilt mount |
| 75 | Revolver 50 mounting aperture |
| 76 | Aperture for assembly and adjustment of the device |
| 77 | Receiver of bow mounting means (threaded aperture or the like) |
| 78 | Tilt electrical wiring/conductors |
| 79 | Electrical end plug for Tilt wiring |
| 80 | Left and right Tilt switch adjustment means (fasteners or the like) |
| 83 | Mount means for light source 95 and revolver enclosure 50 assembly |
| 84 | Assembly of light source 95 and revolver enclosure 50 |
| 85 | Apertures through mounting knob 83 to accept individual optic strands 36 and to extend through the knob 83 the light source 95 |
| 90 | Electrical component layout |
| 91 | Electrical component schematic |
| 92 | Prototype Electrical wiring |
| 93 | Circuit board with adjustment features |
| 94 | Internal Electrical wiring/conductors |
| 95 | Laser light source (such as diodes or the like) |
| 96 | Batteries |
| 97 | Normally closed - Tilt from level - open switches or equal |
| 100 | Bow with mounted revolver and sight |
| 101 | Level indicator |
| 101A | Un-level indicated on level indicator |
| 102 | Prey/game or target |
| 103 | Prior art bow with optical sight |
| 104 | Prior art optical sight |
| 105 | Additional prior art optical sight |
| 106 | Example of targets used while setting the bow sights with the arrows shot |

DETAILED DESCRIPTION OF PREFERRED EMBODIMENT

The present development is a Special Bow Sighting Improvement device known as the Revolver. Particularly this product is related to sights for archery bows or firearms employing fiber optic elements and, more specifically, to sight pin constructions which provide increased focus and stability to the fiber optic element by illuminating one pin only and by providing a leveling function to the optic system.

Taught here are a device to improve the sighting process for archery bows or firearms that employ fiber optic elements and, more specifically, to improve the use of sight pin constructions by providing an increased focus and stability to the fiber optic element by illuminating one pin only and by providing a leveling function to the optic system.

The advantages for the Special Bow Sighting Improvement device known as the Revolver are that the Special Bow Sighting Improvement device known as the Revolver may significantly assist an archer's ability to concentrate and make a better sighting and shot at a contest target or hunting prey by eliminating or reducing several distractions during the bow sighting process. When sighting the bow, the use of the Special Bow Sighting Improvement device known as the Revolver:

- permits the archer to concentrate on one pin;
- prevents a blurred condition of sight pins; and
- may have the no-tilt option to remove the added distraction of a non-plumb/canted bow.

The installation, production and marketing of the device:

- easily adapts to the current bow mounts;
- easily adapts to current optical bow sights;
- may be packaged for retail or internet sales;
- may be manufactured in low or high volume builds;
- uses readily available materials and components; and
- uses existing production processes and equipment.

The preferred embodiment of the Special Bow Sighting Improvement known as the Revolver is comprised of (a) a revolver device with a power source, light source and a control system with features; (b) a means to attach the revolver to an optical bow sight that sight having at least two fiber optic sight tips powered each by a fiber strand; and, (c) a means to attach the revolver device to an archery bow wherein the control system may singularly power one fiber optic strand and light one sight tip and wherein the intensity of the lighting of the tip may be controlled. An optional additional embodiment includes the above and is comprised additionally of (d) a tilt/torque switch assembly and (e) a means for connecting the tilt switch assembly to the revolver control system wherein the level and plumb-ness of the bow may control the lighting source to the bow tips.

There is shown in FIGS. 1-18 a complete description and operative embodiment of the Special Bow Sighting Improvement known as the Revolver. In the drawings and illustrations, one notes well that the FIGS. 1-7 demonstrate the general configuration for this product, FIG. 1 B, FIG. 11, FIG. 12 and FIG. 13 demonstrate the use of this product, and FIG. 18 show some of the general prior art in this field of the invention. The various examples of uses are discussed in the operation and use section, below.

The accompanying drawings, which are incorporated in and constitute a part of this specification, illustrate an embodiment of the Special Bow Sighting Improvement known as the Revolver that is preferred. The drawings together with the summary description given above and a detailed description given below serve to explain the principles of the device. It is understood, however, that the Special Bow Sighting Improvement known as the Revolver is not limited to only the precise arrangements and instrumentalities shown. Other examples of bow sighting devices and accessories are still understood by one skilled in the art of bow sights, leveling devices and laser-optic devices to be within the scope and spirit shown here.

FIGS. 1 A and 1 B are sketches of the Special Bow Sighting Improvement known as the Revolver 31 with the tilt/torque feature 70 and the device mounted onto a bow 80.

FIGS. 2 A through 2 E are sketches of the Special Bow Sighting Improvement device 31 known as the Revolver and other general views and alternative embodiments for the device. One notes here the device 31, the device 31 mounted to the bow 80; the general components of the device 32; a device with the revolver only 41; and the general electrical/mechanical control layout 90. All these are explained in detail below.

Figures 3, 3A, 3B, 3C:
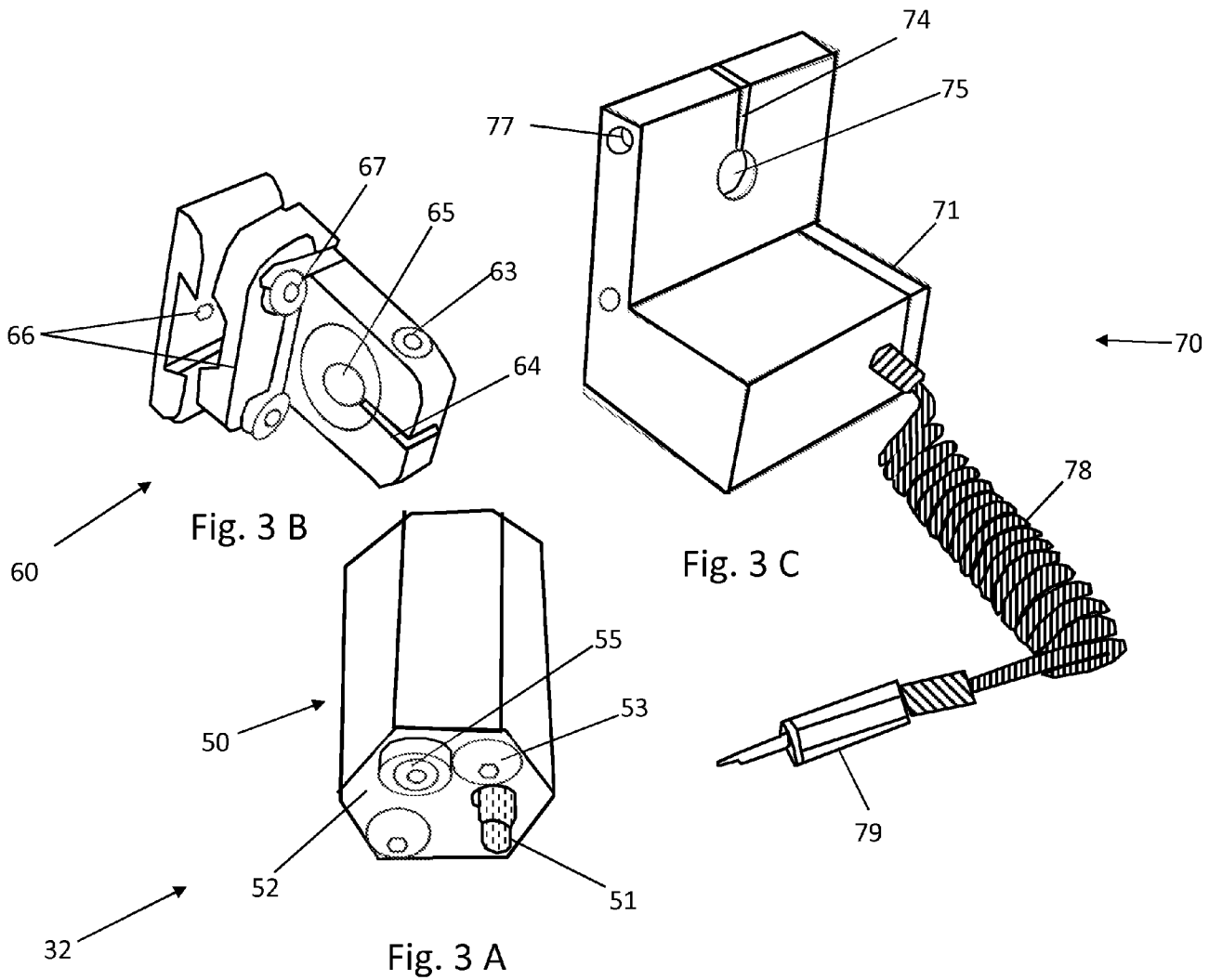
FIGS. 3 A through 3 C are sketches of the general parts of the Special Bow Sighting Improvement known as the Revolver with components and features noted.

FIGS. 3 A through 3 C are sketches of the general parts 32 of the Special Bow Sighting Improvement device 31 known as the Revolver with components and features noted. In these views, the revolver enclosure 50, the revolver only mount 60 and the revolver with tilt function mount 70 are shown. In FIG. 3 A the revolver enclosure 50 has an end plate or face cover 52 where the electrical plug receiver 55, the selection switch 51 and the face cover 53 mounting fasteners 53 are depicted. The enclosure 50 is the surrounding container that is made of a durable material such as a metal (steel a steel alloy like stainless, aluminum, brass, or the like with or without a coating like powder coat, chrome plating, paint or other) or a composite material (such as a plastic like delrin, nylon, an ethylene, a urethans or equal). These materials may be machined, cast or molded to form the revolver enclosure with the apertures 51A discussed later. In FIG. 3 B the revolver only mount 60 is shown. The features depicted are the aperture 65, the slot 64 and the tightening means 63 such as a fastener or equal, for mounting the revolver 50. The mount 50 includes the clamp structure 66 and means to lock 66 or secure the clamp 66 to the bow 80 (not shown here). In FIG. 3 C the revolver and tilt mount 70 is shown. The features depicted are the aperture 75, the slot 74 and the tightening means 73 such as a fastener or equal, for mounting the revolver 50. Also shown here is the end plate 71, the tilt electrical wire/conductors 78 and the electrical jack plug 79. The materials for the revolver mount only 60 and the revolver and tilt mount 70 may be metal or a composite similar to the revolver materials discussed above.

Figure 4:
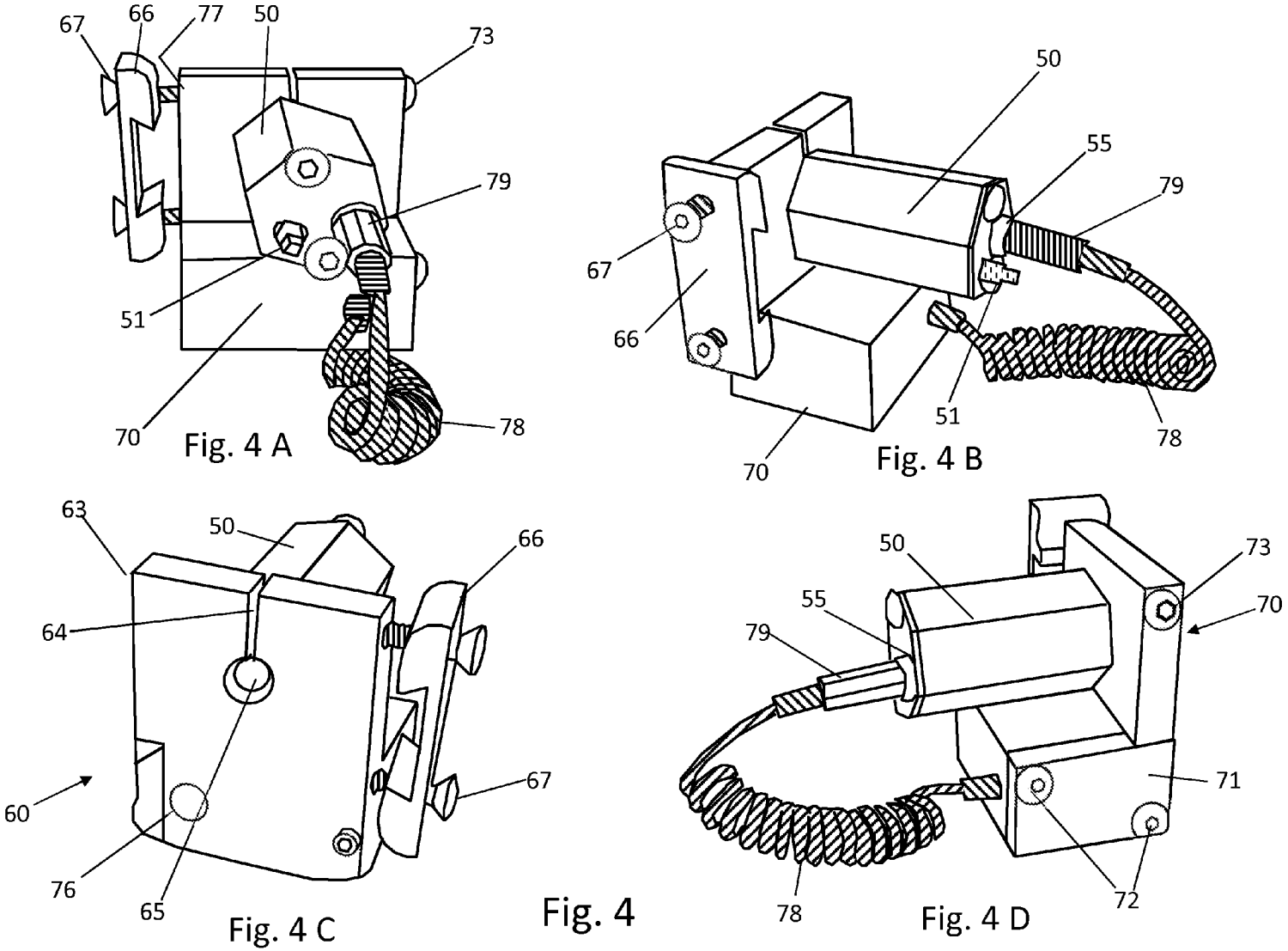
FIGS. 4 A through 4 D are sketches of a prototype sample of the Special Bow Sighting Improvement known as the Revolver with the components and features shown from several views.

FIGS. 4 A through 4 D are sketches of a prototype sample of the Special Bow Sighting Improvement device 31 known as the Revolver with the components and features shown from several views. Most of the components and features are described above. In addition, various views of the switch 51 and of the electrical plug 79 is engaged into the plug receiver 55 on the revolver enclosure 50. Also the tilt mount cover 71 has the means to secure 72 such as fasteners shown. An end view shows the bow mount clamp 66 with the fasteners 67 and shows the aperture 76 used to assemble and adjust the tilt device 70.

FIGS. 5 A and 5B are sketches of a prototype sample device 31A of the Special Bow Sighting Improvement known as the Revolver with the components and features from generally the bow sight end and revolver enclosure end views. The various components have been described. In addition, In FIG. 5 A the fiber optics 36 and the adjustment knobs 37 for the bow sight 35 are depicted. These are readily available components known well by an ordinary person skilled in the field of archery and bow devices. In FIG. 5 B the slot 66A of the clamp mount 66 is viewed. The actual configuration and design may vary yet the clamp mount is still intended and falls within the scope and spirit of the entire invention.

FIGS. 6 A through 6 D are sketches of the Special Bow Sighting Improvement device from top, side end and isometric views. The components and features are as described above.

FIGS. 7 A through 7 C are sketches of the prototype of the tilt/torque device from side, top and bottom views. Most of the components and features are as described above. In FIG. 7 C the bottom view, one sees the adjustment means 80 to dial in and adjust the left and right tilt switches 97 (discussed below).

FIGS. 8 A through 8 C are sketches of the prototype of the tilt/torque device 70 from the Revolver end and from the bow sight end. Most of the components and features are as described above. However in the views the fiber optics 36 of the bow sight 35 are shown as an array of strands leading to and connected directly to each bow sight tip 38. Each fiber 36 in turn connects back to the light assembly knob 83 with apertures 85 for individual fibers 36.

Figure 9:
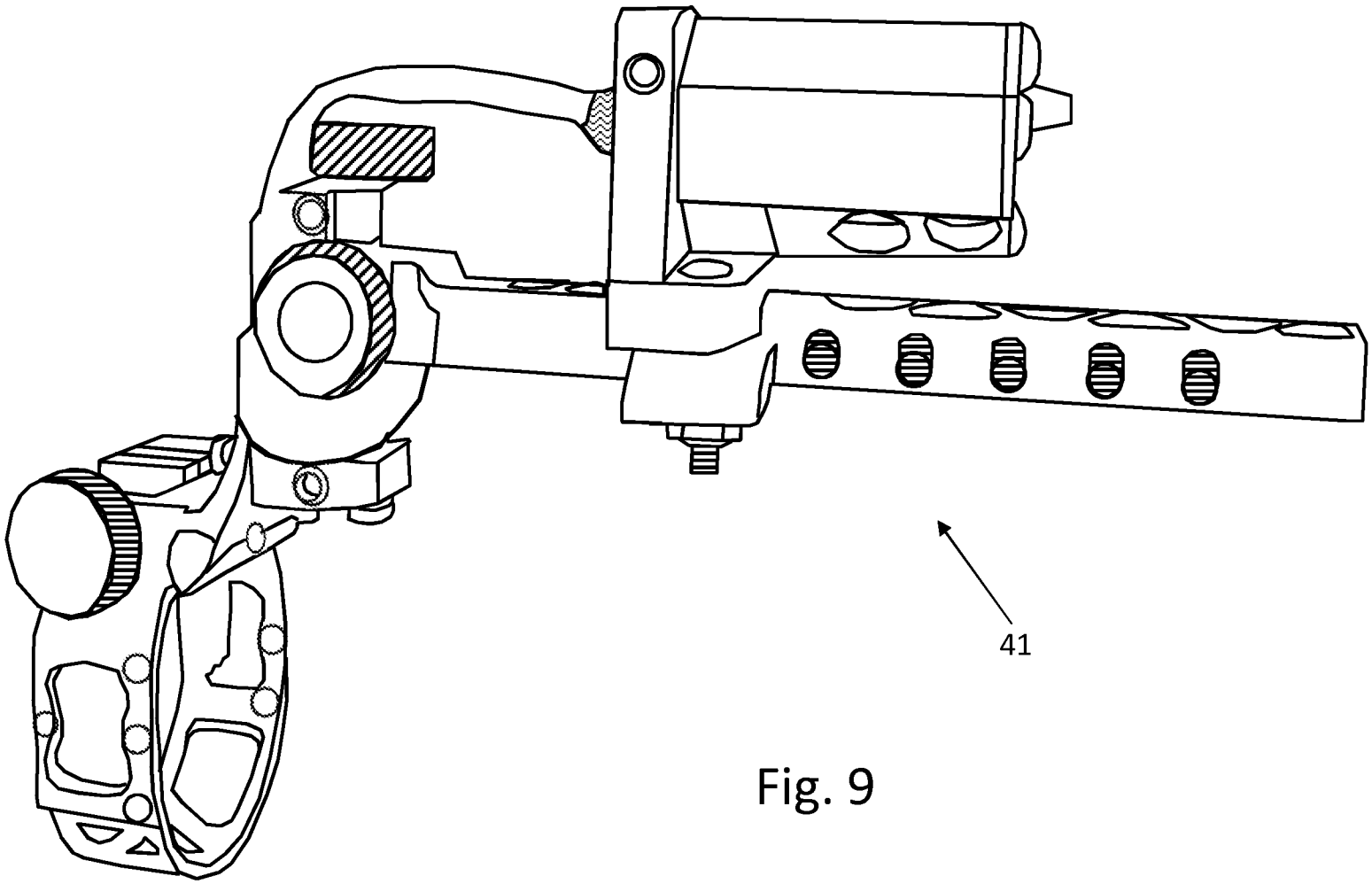
FIG. 9 is a sketch of the Special Bow Sighting Improvement known as the Revolver without the tilt/torque function.

FIG. 9 is a sketch of the Special Bow Sighting Improvement device 31 known as the Revolver without the tilt/torque function 41.

FIGS. 10 A through 10 D are sketches of a prototype sample of the Special Bow Sighting Improvement known as the Revolver without the tilt/torque function 41 with the components and features. The components and features are as described above.

Figures 11, 11A, 11B, 11C, 11D:
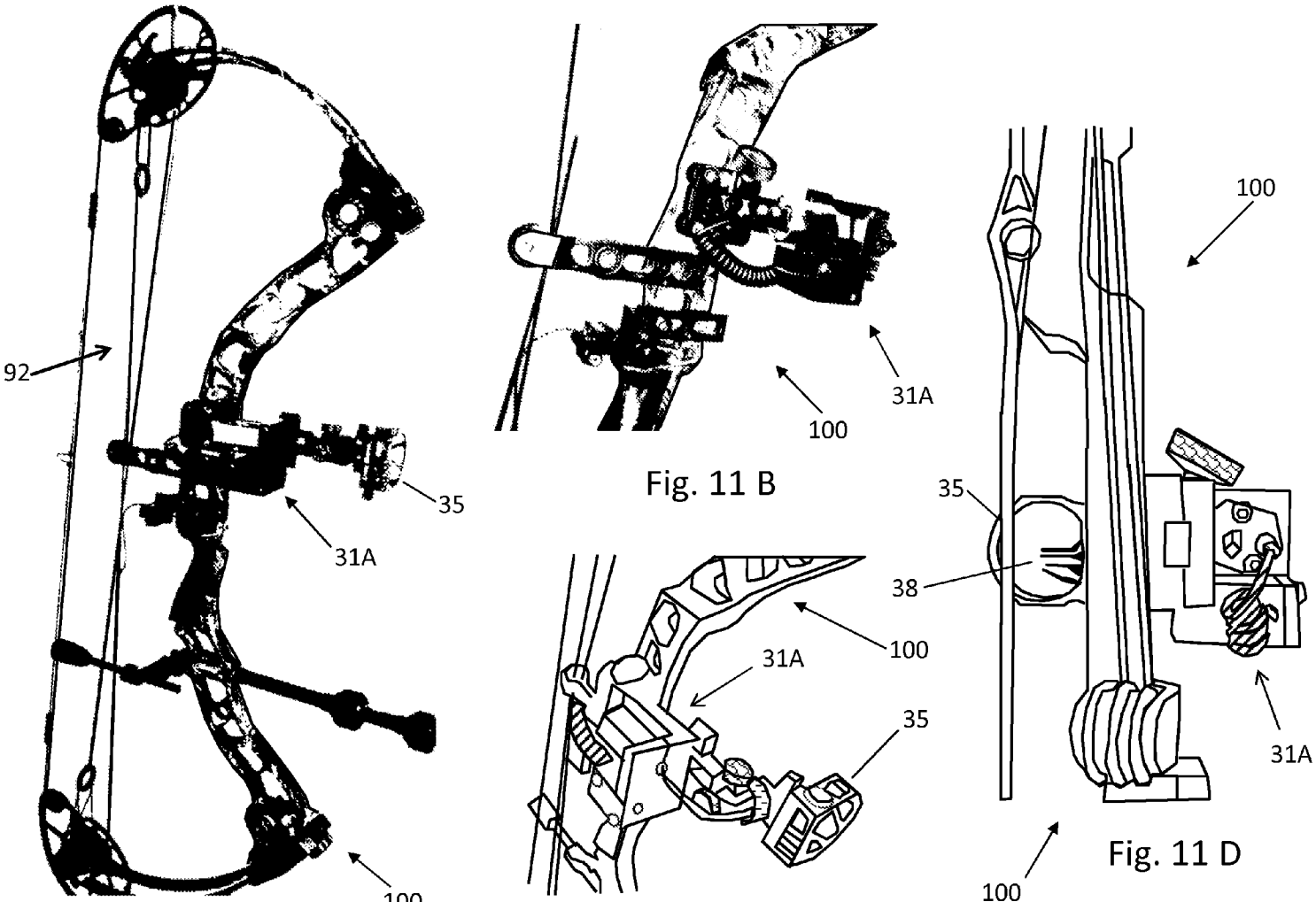
FIGS. 11 A through 11 D are sketches of a prototype sample of the Special Bow Sighting Improvement device mounted onto the bows.

FIGS. 11 A through 11 D; FIGS. 12 A through 12 F; and FIGS. 13 A through 13 C are sketches of uses and are described below.

FIGS. 14 A through 14 C are sketches of a prototype sample electrical circuits 92, enclosure 50 and the electrical layout 90 of the system. In FIG. 14 A, the electrical wiring 92 shows the aperture 51A for the batteries 96, and the wiring of the light source 95, conductors 94, the plug 55, the selection switch 51 and the circuit board 93 all of which are enclosed inside the enclosure 50 and covered by the end plate 52. Other attributes of the electrical components are discussed in the FIG. 15, next.

Figures 15, 15A, 15B:
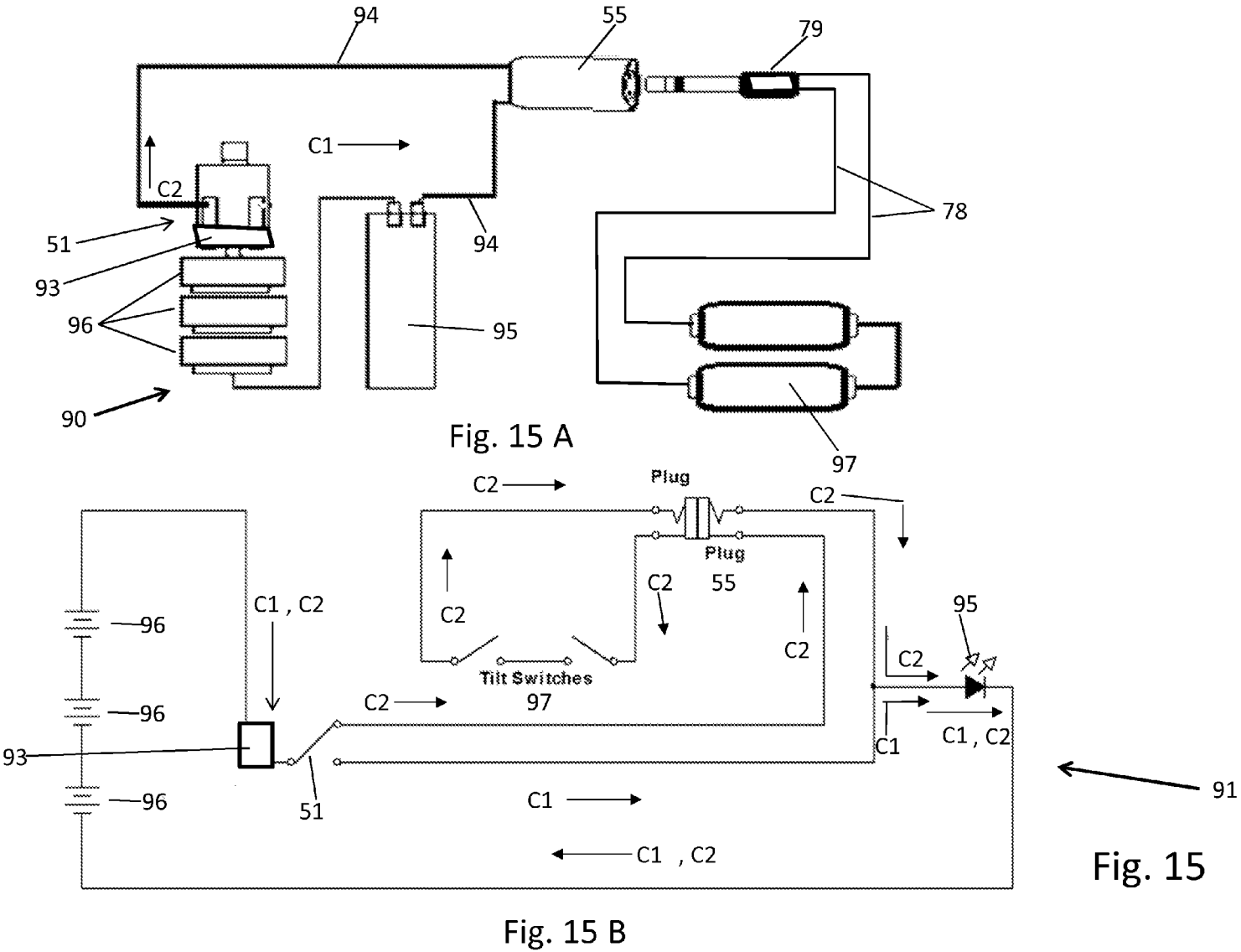
FIGS. 15 A and 15 B are sketches of the electrical layout and the electrical schematic of the system.

FIGS. 15 A and 15 B are sketches of the electrical layout 90 and the electrical schematic 91 of the invention. In both views FIGS. 15 A and 15 B, the components are shown as the batteries 96; the conductor wires 94; the circuit board 93 attached to the selector switch 51; and the light source 95 such as a laser diode or equal. The circuit represented as C-1 shows the electrical source power from the batteries 96; through the circuit board 93; through the switch 51; next feeding direct to the light source 95; and completing the circuit back to the batteries 96. The light from the source 95 travels through the knob 83 apertures 85 and through the fiber optic strands to the bow sight 35 tips 38. The alternative circuit C-2 is the power from the batteries 96; travelling to the circuit board 93; through the switch 51 thrown to direct the power to the alternative route; on the alternative C-2 through the electrical wiring 78; through the plug 55; directed to the tilt switches 97 (left and right); back through the plug 55 and through the other conductor of the wiring 78; to the light source 95; and back to the batteries 96. One skilled in the art of electrical controls realizes there are a plethora of control circuits, boards, and components (discrete and as integrated circuits) that could be configured to provide a control that achieves the control operation anticipated in the spirit and scope of the Revolver—with and without the tilt function. As an example and not as a limitation, the components considered may be: batteries 96—small and powerful lithium ion; or equal—light weight, onetime use or rechargeable; optional circuit board 93—lightweight and compact, able to control power with some resistance, diode, transistor or capacitor combination— discrete or in an integrated circuit board; switch 51—push button or toggle, single throw, double pole ore equal, compact, power rated to the circuit needs; electrical conductors—rated to power of circuit, durable; electric jack plug 77 compact and rated according to the power requirements; left and right tilt switches—97 environmentally safe, adjusted fit with external adjustment means 80; light source—laser diode or equal; all with an enclose of the revolver 50 or the tilt 70 as discussed above. One also appreciates the tilt switches 97 may be (for example and not as a limitation) mercury, magnetic, electronic, reed, ball bearing or bin switches FIGS. 16 A through 16 D are sketches and drawings of a prototype layout of the Special Bow Sighting Improvement device. The components and features are as described above.

Figures 17, 17A, 17B, 17C, 17D, 17E, 17F:
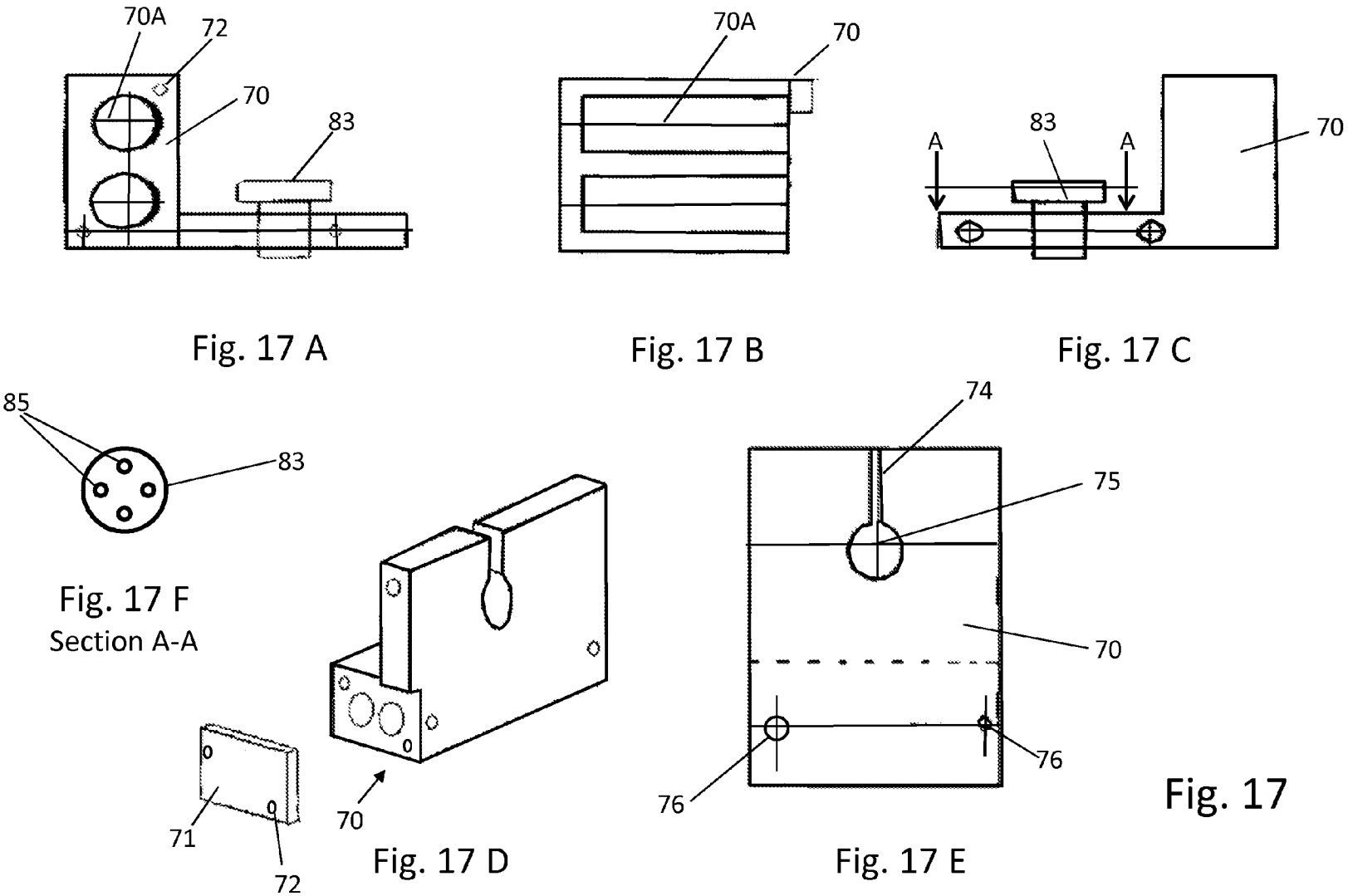
FIGS. 17 A through 17 F are additional sketches of a prototype of the device.
Figures 18, 18A, 18B, 18C, 18D:
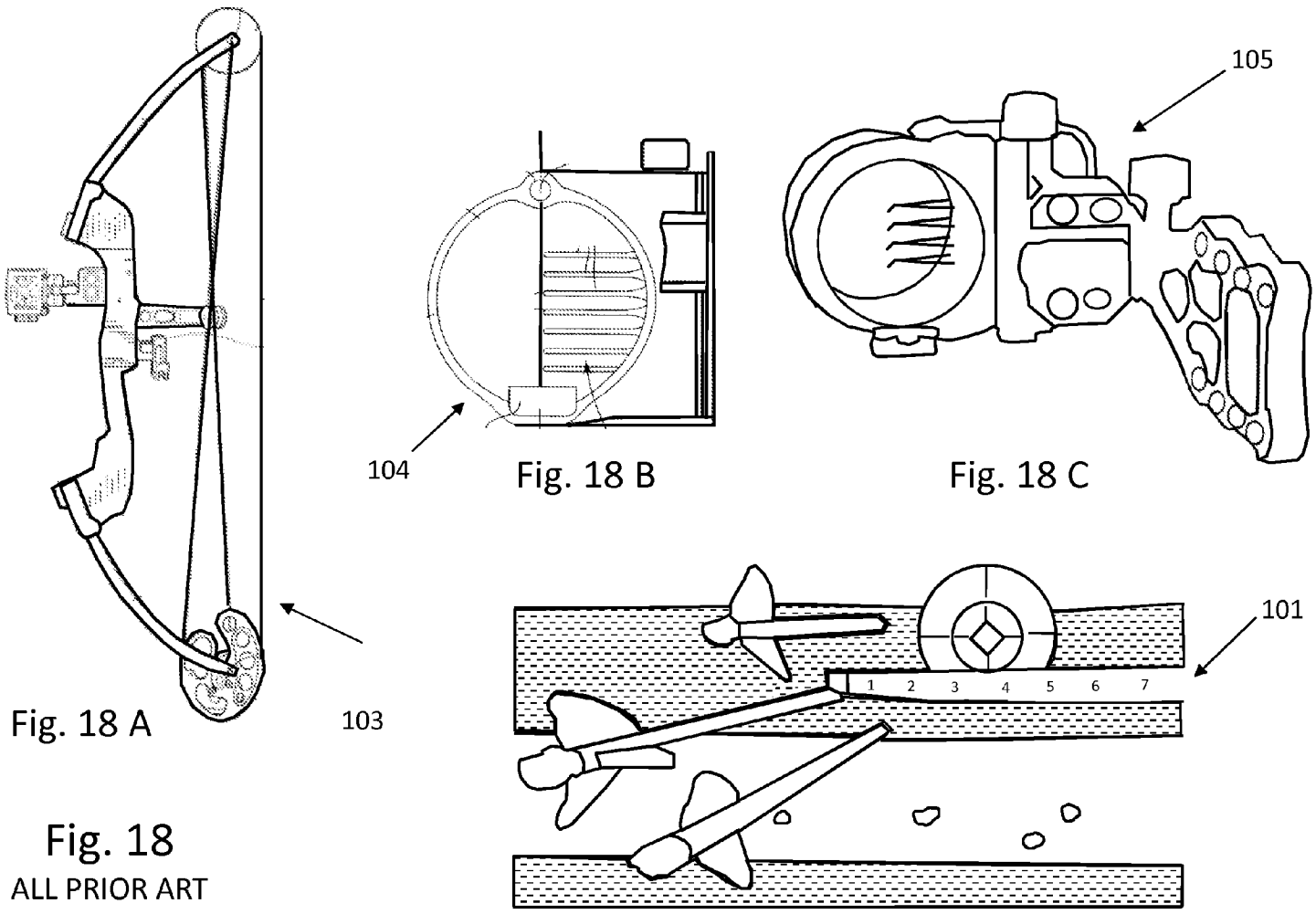
FIGS. 18 A through 18 D are sketches of prior art for bow sight devices.

FIGS. 17 A through 17 F are additional sketches of a prototype of the device. Most of the components and features have been described above. Important attention is placed with the light mounting knob 83. Here are shown the Apertures 85 through mounting knob 83 to accept individual optic strands 36 and to extend through the knob 83 to the light source 95.

FIGS. 18 A through 18 D are sketches of prior art for bow sight devices. The bow and sight 103 is shown in FIG. 18 A. Two different sights 104, 105 are shown in FIGS. 18 B and 18 C. In FIG. 18 D is depicted how bow sights are sighted-in and adjusted by making multiple shots and adjusting the sight pins 38 either left and right for wind age or up and down for elevation.

The details mentioned here are exemplary and not limiting. Other specific components and manners specific to describing a Special Bow Sighting Improvement known as the Revolver 31 may be added as a person having ordinary skill in the field of bow and bow sighting devices, laser lighting techniques, and fiber optics and all the related uses well appreciates.

Operation of the Preferred Embodiment

The Special Bow Sighting Improvement device known as the Revolver 31 has been described in the above embodiment. The manner of how the device operates is described below. One notes well that the description above and the operation described here must be taken together to fully illustrate the concept of the Special Bow Sighting Improvement device 31. The preferred embodiment of the Special Bow Sighting Improvement known as the Revolver is comprised of (a) a revolver device with a power source, light source and a control system with features; (b) a means to attach the revolver to an optical bow sight that sight having at least two fiber optic sight tips powered each by a fiber strand; and, (c) a means to attach the revolver device to an archery bow wherein the control system may singularly power one fiber optic strand and light one sight tip and wherein the intensity of the lighting of the tip may be controlled. An optional additional embodiment includes the above and is comprised additionally of (d) a tilt/torque switch assembly and (e) a means for connecting the tilt switch assembly to the revolver control system wherein the level and plumb-ness of the bow may control the lighting source to the bow tips.

The Special Bow Sighting Improvement known as the Revolver 31 is operated by the user/archer adjusting and connecting the components that have the desired functions. First, the Revolver 50 permits one to set the light source 95 to one single bow sight 35 pin 38. The single pin 38 is then illuminated. It may be dialed at full brightness (for high daylight intensity) or tuned so that less light comes from the source 95 by turning the revolver so that the aperture 85 in the knob 83 which holds the fiber optic strand is not directly aligned and so the light transfer is less and the resultant light emitted at the bow sight 38 is less (eg dimmer in intensity). The number of fibers depend on the individual bow sight 35. However, once the revolver 50 and bow sight 35 are removably connected between the fiber optics 36 and the apertures 85 in the knob 83, then the individual bow tips—38 A, B, C etc. are lighted singularly as the revolver enclosure 50 turns with the attached light source 95. The revolver enclosure 50 turns circumferentially around the center of the fixed knob 83. Optionally, the tilt function in the tilt mount 70 can be energized by plugging the electrical connector 79 into the revolver electrical receiver 55. That powers the tilt switches 97—left and right. When the switch 51 permits the tilt to be active through circuit C-2 (described above), then the tilt feature is active. If the bow is canted left or right from plumb, the tilt switch 97 opens and power from the batteries 96 to the light source 95 is prevented. Finally, for operation in the field, the switch 51 may be pushed or toggled to bypass the tilt function for times when an archer must take a shot with a canted (non plumb) condition of the bow 80.

Many uses are anticipated for The Special Bow Sighting Improvement device known as the Revolver 31. Some examples, and not limitations, are shown in the following Table.

| ITEM | DESCRIPTION |
|---|---|
| 1 | Archery contests to eliminate cant variables |
| 2 | Archery contests to eliminate multiple pins lighting and blurring |
| 3 | Archery contests to control the light intensity of the bow sight 38 |
| 4 | Bow Hunting applications for cant, blur and single pin |
| 5 | Other sight applications with other weapons that require laser pin sights or the like |
| 6 | Military and Homeland security sighting needs for security operations |

FIG. 1 B is a sketch of the Special Bow Sighting Improvement device 31 known as the Revolver with the tilt/torque features mounted onto a bow 100. One may mount the device with a revolver only mount 60 or a tilt function mount 70. In both cases, the clamp 66 encircles the bow handle and secures the device to the handle by means of the securement fasteners 67. The bow 100 is held in the groove 66 A as described above. On the bow there are standard receiving threads so that no secondary operation to the bow is needed to mount the devices.

FIGS. 11 A through 11 D are various sketches of a prototype sample 31A of the Special Bow Sighting Improvement device mounted onto the bows 100. The components were described above in the detailed description.

FIGS. 12 A through 12 F are sketches showing the single pin 38 versus the multi-pin 39 lighting of the sight pins for the device mounted onto the bow 100. In FIGS. 12 A and 12 B, the individual top pin 38A and middle pin 38C are shown illuminated. The revolver 50 is turned so that the optical strand to each pin 38A, 38C respectively aligns with the light emitter 95 through the aperture 85 in the knob 83 as described above. FIG. 12 C shows the single pin 38B illuminated singularly and sighted on the target game/prey 102. FIG. 12 D shows all the pin 39 illuminated totally and the blur of the pins over the target game/prey 102. Hence the hunter must delay the shot and first concentrate on which bow sight illuminated tip to use. This may cause delay, allow the game/prey 102 to move and disrupt the release of the arrow. FIGS. 12 E and 12 F show the single illuminated tip 38B and all tips 39 illuminated and blurry.

FIGS. 13 A through 13 C are sketches of the Special Bow Sighting Improvement device 31 functioning in the tilt/torque mode or function. Here the level indicator is un-level 101A in FIGS. 13 A and 13 C which opens the circuit at the tilt switches 97. Hence, the open circuit prevents the power from the batteries 96 to power the light source 95. In FIG. 13 B, the indicator 101 is level, the tilt switches 97 are closed and the selected pin—here the second pin 38B—is powered by the batteries 96 to the light source 95 and the emitted light is permitted to illuminate the pin 38B through the fiber optics.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the Special Bow Sighting Improvement known as the Revolver 31 is not to be limited to only the disclosed embodiment of product. The features of the Special Bow Sighting Improvement known as the Revolver 31 are intended to cover various modifications and equivalent arrangements included within the spirit and scope of the description.

What is claimed is:

1. A Special Bow Sighting Improvement comprised of:

(a) a revolver device with an enclosure made of a durable material, a power source, a light source, and a control system with components and features;

(b) a means for attaching the revolver device to an optical bow sight that sight having at least two fiber optic sight tips powered each by a fiber strand;

(c) a means for attaching the revolver device to an archery bow (d) a tilt/torque switch assembly; and (e) a means for connecting the tilt switch assembly to the control system of the revolver device wherein the device may be used for a group of various uses; wherein the control system may singularly power one fiber optic strand and light one sight tip; and wherein the intensity of the lighting of the tip may be controlled and wherein the level and plumb-ness of the bow may control the lighting source to the bow tips.

2. The device according to claim 1 wherein the control components and features are comprised of batteries; a group of conductor wires; a circuit board attached to a selector switch; and a light source.

3. The device according to claim 2 wherein the light source is a laser diode.

4. The device according to claim 1 wherein the tilt switch is selected from the group consisting of mercury, magnetic, electronic, reed, ball bearing and bin switches.

5. The device according to claim 1 wherein the revolver enclosure is comprised of an end plate; an electrical plug receiver; a selection switch; a surrounding container; and a face cover.

6. The device in claim 1 wherein the durable material of the enclosure is selected from the group consisting of a metal, a composite material, a plastic, delrin, nylon, an ethylene, and a urethane.

7. The device according to claim 6 wherein the metal is selected from a group consisting of tilt switch is selected from the group consisting of steel, a steel alloy, stainless steel, aluminum and brass with a coating.

8. The device according to claim 7 wherein the coating is selected from a group consisting of a powder coat, a chrome plating, and a paint.

9. The device according to claim 1 wherein the control components are comprised of at least one battery, a switch and an electrical control device.

10. The device in claim 9 wherein the electrical control device is a circuit board with discrete components.

11. The device in claim 9 wherein the electrical control device is an integrated circuit on a board.

12. The device in claim 9 wherein the switch is selected from a group consisting of a push button, a toggle, a single throw, and a double pole switch.

13. The device according to claim 1 wherein the use of the device is selected from the group consisting of archery contests to eliminate cant variables; archery contests to eliminate multiple pins lighting and blurring; archery contests to control the light intensity of the bow sight; bow hunting applications for cant, blur and single pin control; sight applications with other weapons that require laser pin sights; or military and homeland security sighting needs for security operations.

14. A Special Bow Sighting Improvement and comprised of:

(a) a revolver device with a power source, light source and a control system with components and features;

(b) a means for attaching the revolver device to an optical bow sight, that sight having at least two fiber optic sight tips powered each by a fiber strand;

(c) a means for attaching the revolver device to an archery bow;

(d) a tilt/torque switch assembly; and (e) a means for connecting the tilt switch assembly to the control system of the revolver device wherein the control system may singularly power one fiber optic strand and light one sight tip and wherein the intensity of the lighting of the tip may be controlled and wherein the level and plumb-ness of the bow may control the lighting source to the bow tips.

* * * * *